US005641599A

United States Patent [19]

Markovics et al.

[11] Patent Number: 5,641,599

[45] Date of Patent: Jun. 24, 1997

[54] ELECTROPHOTOGRAPHIC IMAGING MEMBER WITH IMPROVED CHARGE BLOCKING LAYER

[75] Inventors: James M. Markovics, Rochester; Huoy-Jen Yuh, Pittsford; John S. Chambers, Rochester, all of N.Y.

[73] Assignee: Xerox Corporation, Stamford, Conn.

[21] Appl. No.: 587,114

[22] Filed: Jan. 11, 1996

[51] Int. Cl.[6] ..... G03G 5/14

[52] U.S. Cl. ..... 430/59; 430/64

[58] Field of Search ..... 430/63, 64, 65, 430/59

[56] References Cited

U.S. PATENT DOCUMENTS

| | | | |
|---|---|---|---|
| 4,579,801 | 4/1986 | Yashiki | 430/60 |
| 4,618,552 | 10/1986 | Tamaka et al. | 430/60 |
| 4,775,605 | 10/1988 | Seki et al. | 430/63 |
| 4,822,705 | 4/1989 | Fukagai et al. | 430/60 |
| 4,837,120 | 6/1989 | Akiyoshi et al. | 430/56 |
| 4,871,635 | 10/1989 | Seki et al. | 430/60 |
| 4,906,545 | 3/1990 | Fukagai et al. | 430/58 |
| 5,051,328 | 9/1991 | Andrews et al. | 430/56 |
| 5,096,792 | 3/1992 | Simpson et al. | 430/58 |
| 5,139,907 | 8/1992 | Simpson et al. | 430/58 |
| 5,215,839 | 6/1993 | Yu | 430/58 |
| 5,372,904 | 12/1994 | Yu et al. | 430/64 |
| 5,385,796 | 1/1995 | Spiewak et al. | 430/64 |
| 5,401,600 | 3/1995 | Aizawa et al. | 430/65 |
| 5,460,911 | 10/1995 | Yu et al. | 430/64 |
| 5,492,785 | 2/1996 | Normandin et al. | 430/64 |

FOREIGN PATENT DOCUMENTS

0462439A1 12/1991 European Pat. Off. .

*Primary Examiner*—John Goodrow

[57] ABSTRACT

An electrophotographic imaging member including a substrate, a hole blocking layer, an optional interface adhesive layer, a charge generating layer, and a charge transport layer, the blocking layer comprising solid finely divided organic electron transporting pigment particles having a short hole range, dispersed in a film forming polymer matrix.

10 Claims, No Drawings

ELECTROPHOTOGRAPHIC IMAGING MEMBER WITH IMPROVED CHARGE BLOCKING LAYER

BACKGROUND OF THE INVENTION

The present invention relates to an electrophotographic imaging member having an improved hole blocking layer.

Typical electrophotographic imaging members comprise a photoconductive layer comprising a single layer or composite layers. One type of composite photoconductive layer used in xerography is illustrated, for example, in U.S. Pat. No. 4,265,990 which describes a photosensitive member having at least two electrically operative layers. The disclosure of this patent is incorporated herein in its entirety. One layer comprises a photoconductive layer which is capable of photogenerating holes and injecting the photogenerated holes into a contiguous charge transport layer. Generally, where the two electrically operative layers are supported on a conductive layer the photogenerating layer sandwiched between the contiguous charge transport layer and the supporting conductive layer, the outer surface of the charge transport layer is normally charged with a uniform charge of a negative polarity and the supporting conductive layer is utilized as an anode.

As more advanced, complex, highly sophisticated, electrophotographic copiers, duplicators and printers were developed, greater demands were placed on the photoreceptor to meet stringent requirements for the production of high quality images. For example, the numerous layers found in many modern photoconductive imaging members must be uniform, free of defects, adhere well to to adjacent layers, and exhibit predictable electrical characteristics within narrow operating limits to provide excellent toner images over many thousands of cycles. One type of multilayered photoreceptor that has been employed as a drum or belt in electrophotographic imaging systems comprises a substrate, a conductive layer, a charge blocking layer, an adhesive layer, a charge generating layer, and a charge transport layer. This photoreceptor may also comprise additional layers such as an overcoating layer. Although excellent toner images may be obtained with multilayered photoreceptors, it has been found that the numerous layers limit the versatility of the multilayered photoreceptor. For example, these photoreceptors often comprise a metal substrate having a roughened surface to avoid imagewise constructive interference effects, known as plywooding, that can occur with laser exposure systems. This surface is coated with a typical film forming hole blocking layer such as nylon, zirconium silane, and the like, to provide the charge blocking function. These materials, especially nylons, depend on water content to provide sufficient conductivity to bleed off negative charge residual in the charge generating layer. Although many electrophotographic imaging members perform well under normal ambient atmospheric conditions, they are sensitive to relative humidity such that their performance degrades in low humidity conditions. This is due to insufficient bleeding off of charge. Also, under high humidity conditions, too much charge bleeds off between the uniform charging step and image developing step, for example leading to print defects which appear as black spots in the background areas with a discharge area development printer, copier or printer.

For electrophotographic imaging systems which utilize uniform negative polarity charging prior to imagewise exposure, it is important that the charge blocking layer bleeds off negative charge while preventing positive charge leakage.

Although insulating type polymers can efficiently block hole injection from the underlying ground plane, their maximum thickness is limited by the inefficient transport of the photoinjected electrons from the generator layer to the substrate. If a charge blocking layer is too thick, resistivity of the layer increases and blocks passage of both negative and positive charges. Thus, the charge blocking coating must be very thin and this thin blocking layer coating often presents still another problem, the incomplete coverage of the underlying substrate due to inadequate wetting on localized unclean substrate surface areas. Coating thickness nonuniformity will lead to charge leakage. Further, blocking layers that are too thin are more susceptible to the formation of pinholes which allow both negative and positive charges to leak through the charge blocking and result in print defects. Also, when charge blocking layers are too thin, small amounts of contaminants can adversely affect the performance of the charge blocking layer and cause print defects due to passage of both negative and positive charges through the layer. Defects in hole blocking layer which allow both negative and positive charges to leak through lead to the development of charge deficient spots associated with copy print-out defects.

Moreover, alteration of materials in the various photoreceptor layers such as the charge blocking layer can adversely affect overall electrical, mechanical and other electrophotographic imaging properties such as residual voltage, background, dark decay, adhesion and the like, particularly when cycled thousands or hundreds of thousands of times in environments where conditions such as humidity and temperature can change daily.

INFORMATION DISCLOSURE STATEMENT

U.S. Pat. No. 4,775,605 to Seki et al., issued Oct. 4, 1988—A repeatedly reusable photosensitive material for electrophotography is disclosed comprising an electroconductive substrate, a photosensitive layer and an intermediate layer located between said electroconductive substrate and said photosensitive layer, characterized in that said intermediate layer comprises a dispersion of an electroconductive polymer and an inorganic white pigment. The white pigment has a refractive index of not less than 1.9, e.g. titanium dioxide, zinc oxide, zinc sulfide, white lead, lithopone and the like.

U.S. Pat. No. 5,215,839 to Yu, issued Jun. 1, 1993—A layered imaging member is disclosed which is modified to reduce the effects of interference within the member caused by reflections from coherent light incident on a ground plane. The modification described involves formation of an interface layer between a blocking layer and a charge generation layer, the interface layer comprising a polymer having incorporated therein filler particles of synthetic silica or mineral particles. A preferred material is aerosil silica from 10 to 80% by weight. The filler particles scatter the light preventing reflections from the ground plane back to the light incident surface.

U.S. Pat. No. 5,401,600 to Aizawa et al, issued Mar. 28, 1995—An intermediate layer is disclosed having fine hydrophobic silica particles positioned between a substrate and a photosensitive layer. The fine hydrophobic silica particles preferably have a primary particle-averaged size of not more than 50 nm and desirably the surface of the fine hydrophobic silica particles is alkyl-silated or treated with silicone.

U.S. Pat. No. 5,372,904 to Yu et al., issued Dec. 13, 1994—An electrophotographic imaging member is disclosed comprising a substrate having an electrically conductive metal oxide surface, a hole blocking layer and at least one electrophotographic imaging layer, the hole blocking layer comprising a reaction product of (a) a material selected from the group consisting of a hydrolyzed organozirconium compound, a hydrolyzed organotitanium compound and mixtures thereof, (b) a hydroxyalkylcellulose, (c) a hydrolyzed organoaminosilane, and (d) the metal oxide surface.

U.S. Pat. No. 5,385,796 to Spiewak et al., issued Jan. 31, 1995—An electrophotographic imaging member is disclosed comprising a substrate having an electrically conductive metal oxide surface, a hole blocking layer and at least one electrophotographic imaging layer, the hole blocking layer comprising a reaction product of (a) a material selected from the group consisting of a hydrolyzed organozirconium compound, a hydrolyzed organotitanium compound and mixtures thereof, (b) a hydroxyalkylcellulose, (c) a hydrolyzed organoaminosilane, and (d) the metal oxide surface.

U.S. Pat. No. 4,579,801 to Yashiki, issued Apr. 1, 1986—An electrophotographic imaging member is disclosed characterized by having a phenolic resin layer formed from a resol coat, between a substrate and a photosensitive layer. This phenolic layer may also comprise a dispersion of conductive powders of metals, e.g. nickel, copper, silver, aluminum, and the like; conductive powders of metal oxides, e.g. iron oxide, tin oxide, antimony oxide, indium oxide, titanium oxide, aluminum oxide and the like; and powders of carbon powder, barium carbonate and barium sulfate. Titanium oxide powder may be treated with tin oxide or alumina. Also, a resin layer free of conductive powder may be utilized between the conductive layer and photosensitive layer.

U.S. Pat. No. 4,837,120 to Akiyoshi et al., issued Jun. 6, 1989—An improved electrophotographic photoconductor is disclosed comprising a cylindrical electroconductive support and a photoconductive layer formed on the electroconductive support, which electroconductive support comprises a base support made of a phenol resin with a releasing rate of ammonia therefrom per 48 hours being 50 ppm or less. An undercoat layer may be interposed between the electroconductive support and photoconductive layer. Such undercoat layer may comprise (i) a resin layer of polyamide (such as Nylon 66 or Nylon 610, copolymer of nylon), polyurethane, or polyvinyl alcohol and (ii) an electroconductive resin layer comprising any of the above resins and finely-divided inorganic particles of titanium oxide, zinc oxide and magnesium oxide.

U.S. Pat. No. 4,871,635 to Seki et al., issued Oct. 3, 1989—A repeatedly usable electrophotographic photoconductor is disclosed comprising (a) and electroconductive support, (b) an undercoat layer containing therein at least one salt selected from the group consisting of carboxylates, amino carboxylates, phosphates, polyphosphates, phosphites, phosphite derivatives, borates, sulfates and sulfites and (c) a photoconductive layer, which layers are successively overlaid on the electroconductive support. The undercoat layer may also contain a binder resin such as polyvinyl alcohol, casein, sodium polyacrylate, nylon, a polyurethane, a melamine resin, or an epoxy resin.

U.S. Pat. No. 4,822,705 to Fukagai et al., issued Apr. 18, 1989—An electrophotographic photoconductor is disclosed comprising an electroconductive support, an intermediate layer formed thereon, an a photoconductive layer formed on said intermediate layer, which intermediate layer comprises at least one component selected from the group consisting of: (a) monohydric aliphatic alcohol, (b) dihydric aliphatic alcohol, (c) polyethylene glycol, (d) polypropylene glycol, (e) polybutylene glycol, (f) polyethylene glycol monoester and/or polyethylene glycol diester, (g) polyethylene monoether, (h) crown ether, (i) a random or block copolymer having as structure units a hydroxyethylene group and a hydroxypropylene group, and hydroxyl groups at the terminal thereof, and (j) a polymer of a monomer having formula (I) and a copolymer of said monomer and a counterpart monomer having a specified structural formula. The intermediate layer also contain electroconductive powders such as tin oxide, antimony oxide, and/or white pigments such as zinc oxide, zinc sulfide, and titanium oxide.

U.S. Pat. No. 4,906,545 to Fukagai et al., issued Mar. 6, 1990—An electrophotographic photoconductor is disclosed, which comprises an electroconductive support, an undercoat layer formed on the electroconductive support, comprising at least one metal oxide selected from the group consisting of zirconium oxide, magnesium oxide, calcium oxide, beryllium oxide and lanthanum oxide, and a photoconductive layer comprising a charge generating layer and a charge transporting layer, formed on the undercoat layer. The oxides may be employed with various thermoplastic or thermosetting binder resins.

U.S. Pat. No. 5,139,907 to Y. Simpson et al., issued Aug. 18, 1992—A layered photosensitive imaging member is described which is modified by forming a low-reflection layer on the ground plane. The low-reflection layer serves to reduce an interference contrast and according to a second aspect of the invention, layer adhesion is greatly improved when selecting $TiO_2$ as the low-reflection material. In a preferred embodiment, low-reflection materials having an index of refraction greater than 2.05 were found to be most effective in suppressing the interference fringe contrast.

U.S. Pat. No. 5,051,328 to J. Andrews et al., issued Sep. 24, 1991—A layered photosensitive imaging member is disclosed which has been modified to reduce the effects of interference within the member caused by reflections from coherent light incident on a base ground plane. The modification described is to form the ground plane of a low-reflecting material such as tin oxide or indium tin oxide. An additional feature is to add absorbing materials to the dielectric material upon which the ground plane is formed to absorb secondary reflections from the anti-curl back coating layer air interface. The absorbing material can be a dye such as Sudan Blue 670.

U.S. Pat. No. 4,618,552 to S. Tanaka et al., issued Oct. 21, 1986—A light receiving member is disclosed comprising an intermediate layer between a substrate of a metal of an alloy having a reflective surface on a photosensitive member, the reflective surface of the substrate forming a light-diffusing reflective surface, and the surface of the intermediate layer forming a rough surface. A light receiving member comprising a subbing layer having a light diffusing reflective surface with an average surface roughness of half or more of the wavelength of the light source for image exposure is provided between an electroconductive surface and a photosensitive layer. A light absorber may also be contained in the electroconductive layer.

U.S. Pat. No. 5,096,792 to Y. Simpson et al, issued Mar. 17, 1992—A layered photosensitive imaging member is disclosed which is modified to reduce the effects of interference within the member caused by reflections from coherent light incident on a base ground plane. The modification involves a ground plane surface with a rough surface morphology by various selective deposition methods. Light reflected from the ground plane formed with the rough surface morphology is diffused through the bulk of the photosensitive layer breaking up the interference fringe patterns which are later manifested as a plywood pattern on output prints made from the exposed sensitive medium.

European Patent Application No. 0 462 439 A1, published Dec. 27, 1991—A layered photosensitive medium is modified to reduce the effects of destructive interference within the medium caused by reflection from coherent light incident thereon. The modification is to roughen the surface of the substrate upon which the ground plane is formed, the ground plane formed so as to conform to the underlying surface roughness. Light reflected from the ground plane is diffused through the bulk of the photosensitive layer breaking up the interference fringe patterns which are later manifested as a plywood defect on output prints made from the exposed photosensitive medium.

CROSS REFERENCE TO RELATED APPLICATIONS

U.S. Pat. No. 5,460,911 to Yu et al, Ser. No. 209,894, issued Oct. 24, 1995, by Robert C. U. Yu et al., entitles et al., entitled ELECTROPHOTOGRAPHIC IMAGING MEMBER FREE OF REFLECTION INTERFERENCE—An electrophotographic imaging member is disclosed comprising a substrate, a hole blocking, an optional interface adhesive layer, a charge generating layer, and a charge transport layer, the hole blocking layer comprising a light absorbing material selected from the group consisting of a dye, pigment, or mixture thereof dissolved or dispersed in a hole blocking matrix comprising a film forming polymer, the light absorbing material being capable of absorbing incident radiation having a wavelength between about 550 and about 950 nm. The dye or pigment may have a violet, blue, green, cyan or black color to absorb incident radiation having a wavelength between about 550 and about 950 nm. These imaging members may be utilized in an electrophotographic imaging process.

U.S. patent application Ser. No. 08/584,793 pending, filed concurrently herewith by Robert C. U. Yu and entitled "ELECTROPHOTOGRAPHIC IMAGING MEMBER HAVING ENHANCED LAYER ADHESION AND FREEDOM FROM REFLECTION INTERFERENCE"—An electrophotographic imaging member is disclosed including a substrate, a charge blocking layer, an optional adhesive interface layer, a charge generating layer, and a charge transport layer, the blocking layer comprising solid finely divided light scattering inorganic particles having an average particle size between about 0.3 micrometer and about 0.7 micrometer selected from the group consisting of amorphous silica, mineral particles and mixtures thereof, dispersed in a matrix material comprising the chemical reaction product of (a) a film-forming polymer selected from the group consisting of hydroxyalkylcellulose, hydroxy alkyl methacrylate polymer, hydroxy alkyl methacrylate copolymer and mixtures thereof and (b) an organosilane.

U.S. patent application Ser. No. 08/583,904, now U.S. Pat. No. 5,612,157, filed concurrently herewith by James M. Markovics et al. and entitled "CHARGE BLOCKING LAYER FOR ELECTROPHOTOGRAPHIC IMAGING MEMBER"—An electrophotographic imaging member is disclosed including a substrate, a hole blocking layer comprising hydrolyzed metal alkoxide or aryloxide molecules and a film forming alcohol soluble nylon polymer, an optional interface adhesive layer, a charge generating layer, and a charge transport layer.

While the above mentioned electrophotographic imaging members may be suitable for their intended purposes, there continues to be a need for improved imaging members exhibiting high quality and long service life under ambient humidity extremes.

SUMMARY OF THE INVENTION

It is therefore an object of the present invention to provide improved electrophotographic imaging members which overcome the above noted shortcomings.

It is also an object of the present invention to provide an improved layered electrophotographic imaging member that is more environmentally insensitive.

It is yet an object of the present invention to provide an improved electrophotographic imaging member having a blocking layer that has a uniform thickness.

It is a further object of the present invention to provide improved electrophotographic imaging members which can be applied as a thicker layer.

It is yet another object of the present invention to provide improved electrophotographic imaging members which remains effective in both low and high humidity conditions.

It is also another object the present invention to provide improved negative charging electrophotographic imaging members which exhibit low residual voltages when extensively cycled.

It is yet a further object of the present invention to provide an improved electrophotographic imaging member having a blocking layer that blocks holes.

It is still a further object of the present invention to provide an improved electrophotographic imaging member having a hole blocking layer which suppresses the development of charge deficient spots associated with copy printout defects.

It is still yet another further object of the present invention to provide an electrophotographic imaging member that exhibits high quality imaging and printing characteristics.

These and other objects of the present invention are accomplished by providing an electrophotographic imaging member comprising a substrate, a charge blocking layer, an optional adhesive interface layer, a charge generating layer, and a charge transport layer, the charge blocking layer comprising solid finely divided organic electron transporting pigment particles having a short hole range dispersed in a film forming polymer matrix. These imaging members may be utilized in any suitable electrophotographic imaging process.

The supporting substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or an organic composition. As electrically non-conducting materials, there may be employed various resin binders known for this purpose including polyesters, polycarbonates such as bisphenol polycarbonates, polyamides, polyurethanes, polystyrenes and the like. The electrically insulating or conductive substrate may be rigid or flexible and may have any number of different configurations such as, for example, a cylinder, a sheet, a scroll, an endless flexible belt, and the like.

The thickness of the substrate depends on numerous factors, including beam strength and economical considerations, and thus this layer for a flexible belt may be of substantial thickness, for example, about 125 micrometers, or of minimum thickness less than 50 micrometers, provided there are no adverse effects on the final electrostatographic device.

The conductive surface of the supporting substrate may comprise an electrically conductive material that extends through the thickness of the substrate or may comprise a layer or coating of electrically conducting material on a self supporting material. Where the entire substrate is an electrically conductive metal, the outer surface thereof can perform the function of an electrically conductive layer and a separate electrical conductive layer may be omitted. A conductive layer may vary in thickness over substantially wide ranges depending on the degree of optical transparency and flexibility desired for the electrostatographic imaging member. Accordingly, for a flexible imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing or sputtering technique. Typical metals include aluminum, zirconium, niobium, tantalum, vanadium and hafnium, titanium, nickel, stainless steel, chromium, tungsten, molybdenum, and the like. The conductive layer need not be limited to metals. Upon exposure to the ambient atmospheric environment, most electrically conductive metal ground plane surfaces react with the atmospheric oxygen and spontaneously forms a thin metal oxide layer on its surface.

The electrically conductive surface is coated with a thin, uniform hole blocking layer of this invention. This hole blocking layer comprises solid finely divided organic electron transporting pigment particles having a short hole range dispersed in a film forming polymer matrix.

Any suitable electron transporting organic pigment having a long electron range and very short hole range may be utilized. Materials described as "electron transporting" as employed herein are defined as materials which will permit electron injection through one surface on one side of the electron transporting layer to a surface on the opposite side. Materials described herein as having a "long electron range" are defined as materials through which electrons transport readily. More specifically, electrons can be injected through these long electron range materials even when the thickness of the material is as high as 30 micrometers. Materials described herein as having a "short hole range" are defined as materials through which holes do not transport or materials which transports holes very poorly. More specifically, holes cannot be injected through these short hole range materials when the thickness of the material is at least about 0.5 micrometer. Charge blocking materials having a short hole range and a thickness of about 1.0 micrometer will totally prevent transport of holes. Short hole range materials having these transport properties include pure short range organic pigment materials and also mixtures of short range organic pigment materials dispersed in a film forming binder. The blocking layer allows migration of electrons from the imaging member surface of the photoreceptor through the hole blocking layer toward the underlying conductive surface during an electrophotographic imaging process.

Typical organic electron transporting organic pigments having a short hole range include, for example, benzimidazole perylene, dibromoanthanthrone, n-type azo pigments, such as chlorodiane Blue and bisazo pigments disclosed in U.S. Pat. Nos. 4,713,307, 4,797,337, 4,833,052, 5,175,258 and 5,244,761 all of these patents being incorporated herein by reference, substituted 2,4-diamino-triazines, n-type polynuclear aromatic quinones, and the like. Preferably, the organic photoconductive electron transporting particles of this invention have an average particle size of between about 0.005 micrometer and about 2 micrometers. Preferably, the particle size is between about 0.01 micrometer and about 0.5 micrometer because a uniform film can then be formed. The organic pigment particles utilized in the hole blocking layer of this invention should also have a maximum particle size of less than about the thickness of the layer to ensure uniformity of layer thickness and electrical properties. Generally, smaller average particle sizes for the organic pigment are preferred over a larger organic pigment particle size.

Any suitable electrically insulating film forming binder may be utilized. The electrically insulating film forming binder forms the matrix in the hole blocking layers of this invention and have a resistivity of at least about $10^8$ ohm/cm. These film forming binders may be soluble in a solvent to facilitate application by conventional coating techniques. Alternatively, they may be in liquid monomeric or prepolymeric form and applied as a liquid followed by polymerization in situ to form a solid matrix. Typical electrically insulating film forming binders includes, for example, poly (vinylbutyral), polycarbonate, polyester, polyvinylperidine, polyurethanes, polyamides, polyamide-imides, polyaminoacids, nylon, polyester, polyvinyl alcohol, polyvinyl acetate, polymethylmethacrylate, and the like and mixtures thereof. The hole blocking layer of this invention preferably comprises between about 40 percent by weight and about 80 percent by weight of the organic pigment particles based on the total weight of the charge blocking layer.

The specific organic pigment particles, the relative amount of the organic pigment particles in the charge blocking layer of this invention, the average particle size of the pigment particles, and the thickness of the hole blocking layer affect the magnitude of permeability of holes therethrough. However, the combination selected should block passage of holes through the thickness of the material. Satisfactory results may be achieved with a hole blocking layer having a thickness between about 0.1 micrometer and about 10 micrometers. Preferably, the thickness is between about 0.5 micrometer and about 5 micrometers for a charge generation layer containing p-type photoactive pigments and between about 0.1 micrometer and about 5 micrometers for a charge generation layer containing n-type pigments because with a p-type charge generator layer, any holes transported through the blocking layer will be injected through the charge generation layer into the charge transport layer, therefore the blocking layer thickness needs to be larger than its hole range. This is not a problem for n-type charge generation layers, since any holes transported through the blocking layer can not be injected through the charge generation layer into the charge transport layer, therefore the blocking layer thickness can be less than its hole range.

The hole blocking layers of this invention are electron transporting under an applied electric field. More specifically, for ordinary electrophotographic fields in the range of between about 5 and about 30 volts per micrometer, these e- transporting hole blocking layers transport approximately 30 percent more electrons than the same material without the e- transporting particles and will transfer photogenerated charges from the charge generation layer to the underlying conductive layer. Generally, the blocking layer of this invention is used in photoreceptors that are uniformly charged with a negative charge prior to exposure. Electrophotographic imaging members containing the hole blocking layers of this invention have performed satisfactorily at relative humidities as low as 1 percent and as high as 80 percent.

Any suitable and conventional techniques may be utilized to mix and thereafter apply the hole blocking layer coating mixture to the substrate. Any suitable solvent or solvent mixtures may be employed to form a coating mixture. Typical solvents include tetrahydrofuran, toluene, methylene chloride, cyclohexanone, n-butylacetate, methylethyl ketone, ethanol, mono-chlorobenzene, and the like, and mixtures thereof. The organic pigment particles employed should be insoluble in the solvent. Typical application techniques include extruding, roll coating, wire wound rod coating, gravure coating, spraying, dip coating, draw bar coating, gravure roll coating, silk screening, air knife coating, reverse roll coating, spray coating, and the like. Drying of the deposited coating may be effected by any suitable conventional technique such as oven drying, infra red radiation drying, air drying and the like. The hole blocking layer coating mixtures of this invention are especially suitable for dip coating processes. For obtaining relatively thick hole blocking layers, the blocking layers are preferably applied by dip coating substrates such as drums in a coating mixture, with the solvent being removed after deposition of the coating by conventional techniques such as by vacuum, heating and the like.

To provide effective hole blocking capabilities, it is also desirable that the hole blocking layer of this invention have an electrical resistivity for hole transport between about $10^7$ ohm-cm and and about $10^{12}$ ohm-cm. A resistivity of less than $10^3$ ohm-cm will result in a large amount of electrical cycle-down whereas an electrical resistivity greater than $10^{12}$ ohm-cm can be too electrically insulating. When the layer is too insulating, a substantial background voltage rise occurs during the electrophotographic image cycling process. For optimum results, an electrical resistivity between about $10^7$ ohm-cm to about $10^{10}$ ohm-cm is desirable. The hole blocking layer of this invention does not depend on environmental humidity because it has intrinsic electron transport properties and does not transport holes or does not transport holes over long distances.

An optional adhesive layer may be applied to the hole blocking layer of this invention. Any suitable adhesive layer may be utilized. Adhesive layer materials are well known in the art. Typical adhesive layer materials include, for example, polyesters, MOR-ESTER 49,000 (available from Morton International Inc.), Vitel PE-100, Vitel PE-200, Vitel PE-200D, and Vitel PE-222 (all Vitels available from Goodyear Tire and Rubber Co.), polyurethanes, and the like. Any suitable solvent or solvent mixtures may be employed to form a coating solution. Typical solvents include tetrahydrofuran, toluene, methylene chloride, cyclohexanone, and the like, and mixtures thereof. Satisfactory results may be achieved with a dry adhesive layer thickness between about 0.05 micrometer and about 0.3 micrometer. Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable charge generating layer may be utilized with the hole blocking layer of this invention. These charge generating layers can contain an n-type material. The expression "n-type material" as employed herein is defined as those photoactive pigments which predominately transport electrons when illuminated with light. Typical n-type materials include dibromoanthanthrone, benzimidazole perylene, zinc oxide, azo compounds such as chlorodiane Blue and bisazo pigments disclosed in U.S. Pat. Nos. 4,713,307, 4,797,337, 4,833,052, 5,175,258 and 5,244,761 all of which patents being incorporated herein by reference, substituted 2,4-dibromo-triazines, polynuclaer aromatic quinones, zinc sulfide and the like. Benzimidazole perylene compositions are well known and described, for example in U.S. Pat. No. 4,587,189, the entire disclosure thereof being incorporated herein by reference. Other suitable n-type photogenerating materials may also be utilized, if desired. For n-type charge generation layers which have organic pigments with very short hole ranges, the holes are readily blocked by the thin hole blocking layer of this invention. Thus, the hole blocking layer of this invention can be formed into very thin layers when an n-type charge generation layer is utilized. However, if the charge generating layer contains p-type organic materials, a thicker charge blocking layer should be employed. The hole blocking layer of this invention permits the use of thicker hole blocking layers when employed in photoreceptors utilizing charge generating layers containing p-type materials without increasing residual voltage or cycle up. The expression "p-type material" and employed herein is defined as photoactive pigments which transport holes upon illumination by light. Typical p-type organic pigments include, for example, metal-free phthalocyanine, titanyl phthalocyanine, gallium phthalocyanine, hydroxy gallium phthalocyanine, chlorogallium phthalocyanine, copper phthalocyanine, and the like. The photogenerating materials selected are preferably sensitive to activating radiation having a wavelength between about 450 and about 900 nm during the imagewise radiation exposure step to form an electrostatic latent image. Examples of photogenerating layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine described in U.S. Pat. No. 3,357,989, metal phthalocyanines such as vanadyl phthalocyanine and copper phthalocyanine. Other n-type photogenerating materials are believed to include quinacridones available from E.I. dupont de Nemours & Co. under the tradename Monastral Red, Monastral violet and Monastral Red Y, Vat Orange 1 and Vat Orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. The charge generating layer may be formed as a uniform, continuous, homogeneous photogenerating layer or as a uniform layer of photoconductive particles dispersed in a film forming matrix.

Any suitable inactive film forming binders may be employed in the photogenerating binder layer including those described, for example, in U.S. Pat. No. 3,121,006, the entire disclosure thereof being incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like. These polymers may be block, random or alternating copolymers.

The photogenerating composition or pigment can be present in the resinous binder composition in various amounts. Generally, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition.

Any suitable and conventional techniques may be utilized to mix and thereafter apply the charge generating layer coating mixture to the hole blocking layer. Typical application techniques include extruding spraying, dip coating, roll coating, wire wound rod coating, and the like. Drying of the deposited coating may be effected by any suitable conventional technique such as oven drying, infra red radiation drying, air drying and the like.

The photogenerating layer containing photoconductive compositions and/or pigments and the resinous binder material generally has a thickness of between about 0.1 micrometer and about 5 micrometers, and preferably has a thickness of between about 0.3 micrometer and about 3 micrometers. The photogenerating layer thickness is related to binder content. Higher binder content compositions generally require thicker layers for photogeneration. Thicknesses outside these ranges can be selected providing the objectives of the present invention are achieved.

Any suitable active charge transport layer may be applied to the charge generating layer. The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

The charge transport layer forming mixture preferably comprises an aromatic amine compound. An especially preferred charge transport layer employed in one of the two electrically operative layers in the multi-layer photoconductor of this invention comprises from about 35 percent to about 45 percent by weight of at least one charge transporting aromatic amine compound, and about 65 percent to about 55 percent by weight of a polymeric film forming resin in which the aromatic amine is soluble. The substituents should be free from electron withdrawing groups such as $NO_2$ groups, CN groups, and the like. Typical aromatic amine compounds include, for example, triphenylmethane, bis(4-diethylamine-2-methylphenyl)phenylmethane; 4,4'-bis(diethylamino)-2,2'-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3-methylphenyl)-(1,1'-biphenyl)-4,4'-diamine, and the like dispersed in an inactive resin binder.

Any suitable inactive resin binder soluble in methylene chloride, chlorobenzene or other suitable solvent may be employed in the process of this invention. Typical inactive resin binders include polycarbonate resin, polyvinylcarbazole, polyester, polyarylate, polyacrylate, polyether, polysulfone, and the like.

If desired, a hole transporting polymer may be utilized alone or in combination with the activating compound and/or inactive resin binder described above. Hole transporting polymers are well known in the art and are described, for example, in U.S. Pat. No. 4,806,443 and U.S. Pat. No. 5,028,687, the disclosures thereof being incorporated herein in their entirely.

Any suitable and conventional technique may be utilized to mix and thereafter apply the charge transport layer coating mixture to the charge generating layer. Typical application techniques include spraying, extrusion coating, dip coating, roll coating, wire wound rod coating, and the like. Drying of the deposited coating may be effected by any suitable conventional technique such as oven drying, infra red radiation drying, air drying and the like.

Generally, the thickness of the transport layer is between about 5 micrometers and about 100 micrometers, but thicknesses outside this range can also be used. The hole transport layer should be an insulator to the extent that the electrostatic negative charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Examples of photosensitive members having at least two electrically operative layers, including a charge generator layer and diamine containing transport layer, are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety. The charge transport layer in conjunction with the generation layer in the instant invention is a material which is an insulator to the extent that an electrostatic negative charge placed on the transport layer is not conducted in the absence of activating illumination.

Any suitable and conventional techniques may be utilized to mix and thereafter apply the charge transport layer coating mixture to the charge generating layer. Typical application techniques include extruding spraying, dip coating, roll coating, wire wound rod coating, and the like. Drying of the deposited coating may be effected by any suitable conventional technique such as oven drying, infra red radiation drying, air drying and the like.

Other layers such as a conventional ground strip layer comprising, for example, conductive particles dispersed in a film forming binder may be applied to one edge of the photoreceptor in contact with the conductive layer, charge blocking layer, adhesive layer or charge generating layer. The ground strip layer may have a thickness between about 7 micrometers and about 42 micrometers.

Optionally, an overcoat layer may also be utilized to improve resistance to abrasion. In some flexible electrophotographic imaging members, an anti-curl back coating may be applied to the side opposite the side bearing the electrically active coating layers in order to provide flatness and/or abrasion resistance. These overcoating and anti-curl back coating layers may comprise organic polymers or inorganic polymers that are electrically insulating or slightly semiconductive. In embodiments using rigid drum imaging devices, an anti-curl coating is not employed.

The electrophotographic imaging member of the present invention may be employed in any suitable and conventional electrophotographic imaging process which utilizes uniform negative charging prior to imagewise exposure to activating electromagnetic radiation.

Any suitable conventional exposure system may be utilized to form electrostatic latent images on the photoreceptors of this invention. For example, uniformly charged imaging members containing the hole blocking layer of this invention may be exposed with monochromatic activating radiation having a wavelength between about 450 nm and about 900 nm to form an electrostatic latent image on the imaging member. This latent image is developed with toner particles using conventional techniques to form a toner image corresponding to the latent image. The toner image is transferred to a receiving member by any suitable well known processes.

The invention will now be described in detail with respect to specific preferred embodiments thereof, it being noted that these examples are intended to be illustrative only and are not intended to limit the scope of the present invention. Parts and percentages are by weight unless otherwise indicated.

COMPARATIVE EXAMPLE I

An electrophotographic imaging member was prepared by applying by dip coating a charge blocking layer onto the honed surface of an aluminum drum having a diameter of 4 cm and a length of 31 cm. The blocking layer coating mixture contained a solution of 8 weight percent polyamide (nylon 6) dissolved in 92 weight percent butanol, methanol and water solvent mixture. The butanol, methanol and water mixture percentages are 55, 36 and 9 percent by weight, respectively. The coating was applied at a coating bath withdrawal rate of 300 mm/minute. After drying in a forced air oven, the blocking layer had a thickness of 1.5 micrometer. The dried blocking layer was coated with a charge generating layer containing 2.5 weight percent hydroxy gallium phthalocyanine pigment particles, 2.5 weight percent polyvinylbutyral film forming polymer and 95 weight percent cyclohexanone solvent. The coating was applied at a coating bath withdrawal rate of 300 millimeters/minute. After drying in a forced air oven, the charge generating layer had a thickness of 0.2 micrometer. The dried generating layer was coated with a charge transport layer containing 8 weight percent N,N'-diphenyl-N,N'-bis(3-methylphenyl)-1,1'-biphenyl-4,4'-diamine, 12 weight percent polycarbonate resin (Makrolon 5705, available from Farbensabricken Bayer A. G.) and 80 weight percent monochlorobenzene solvent. The coating was applied at a coating bath withdrawal rate of 100 millimeters/minute. After drying in a forced air oven, the transport layer had a thickness of 20 micrometers. The device of this comparative example is compared with devices of this invention in TABLE B below.

EXAMPLE II

An electrophotographic imaging member was prepared by following the procedures and using the same materials as described in Comparative Example I except that instead of the blocking layer of Comparative Example I, the following the blocking layer was used. This blocking layer was formed by dip coating the aluminum drum in a blocking layer coating mixture containing 5 weight percent benzimidazole perylene pigment particles, 3 weight percent poly (vinylbutyral) (B79, available from Monsanto Chemical Co.), 92 weight percent n-butylacetate solvent. The weight percent ratio of benzimidazole perylene to poly (vinylbutyral) was 64:36. This coating was applied at a coating bath withdrawal rate of 300 mm/minute. After drying in a forced air oven, the blocking layer had a thickness of 0.5 micrometer. The dried blocking layer was then coated with a charge generator layer and charge transport layer as described in the Example I. The device of this example is compared with other devices in TABLE B below.

EXAMPLE III

An electrophotographic imaging member was prepared by applying by dip coating a charge blocking layer onto the honed surface of an aluminum drum having a diameter of 4 cm and a length of 31 cm. The blocking layer coating mixture contained a mixture containing a 0.5 weight percent hydroxygallium phthalocyanine pigment particles, 4.5 weight percent poly(vinylbutyral) (B73, available from Monsanto Chemical Co.), 95 weight percent cyclohexanone solvent. The weight percent ratio of hydroxygallium phthalocyanine to poly(vinylbutyral) was 10:90. This coating was applied at a coating bath withdrawal rate of 300 millimeters/minute. After drying in a forced air oven, the blocking layer had a thickness of 0.5 micrometer. The dried blocking layer was then coated with a charge generator layer and charge transport layer as described in the Example I. The device of this example is compared with other devices in TABLE B below.

EXAMPLE IV

The electrical properties of the photoconductive imaging samples prepared according to Examples I, II, and III were evaluated with a xerographic testing scanner. The drums were rotated at a constant surface speed of 5.66 cm per second. A direct current wire scorotron, narrow wavelength band exposure light, erase light, and four electrometer probes were mounted around the periphery of the mounted photoreceptor samples. The sample charging time was 177 milliseconds. The exposure light had an output wavelength of 775 to 785 nm and the erase light had an output wavelength of 680 to 720 nm. The relative locations of the probes and lights are indicated in Table A below:

TABLE A

| Element | Angle (Degrees) | Position | Distance From Photoreceptor |
|---|---|---|---|
| Charge | 0 | 0 | Screen at 2 mm |
| Probe 1 | 26 | 9.1 mm | |
| Expose | 45 | 15.7 | N.A. |
| Probe 2 | 68 | 23.7 | |
| Probe 3 | 133 | 46.4 | |
| Erase | 288 | 100.5 | N.A. |
| Probe 5 | 330 | 115.2 | |

The test samples were first rested in the dark for at least 60 minutes to ensure achievement of equilibrium with the testing conditions at 50 percent relative humidity and 72° F. Each sample was then negatively charged in the dark to a potential of about 385 volts. The charge acceptance of each sample and its residual potential after discharge by front erase exposure to 400 ergs/cm$^2$ were recorded. The test procedure was repeated to determine the photo induced discharge characteristic (PIDC) of each sample by different light energies of up to 40 ergs/cm$^2$. The 100 cycle electrical testing results obtained for the test samples of Examples I through III are summarized in Table B below.

TABLE B

| | Example I | | Example II | | Example III | |
|---|---|---|---|---|---|---|
| Example: | Ave n = 2 | range | Ave n = 2 | range | Ave n = 2 | range |
| Dielectric thickness | 6.5 | 0.0 | 6.6 | 0.2 | 5.9 | 0.1 |
| V0 (PIDC) | 379 | 3.2 | 374 | 2.0 | 353 | 3.5 |
| Q/A (PIDC) [nC/cm$^2$] | 49 | 0.2 | 50 | 0.2 | 49 | 0.0 |
| 0.2 s Duration Decay [v] | 17 | 1.1 | 25 | 1.6 | 44 | 3.4 |
| % Dark Decay | 5 | 0.2 | 7 | 0.4 | 13 | 0.9 |
| @0.42 s: VH (0 erg) [v] | 361 | 2.2 | 349 | 0.4 | 309 | 0.1 |
| V (3 erg/cm$^2$) [v] | 86 | 1.3 | 59 | 0.8 | 64 | 0.3 |
| V (7 erg/cm$^2$) [v] | 56 | 1.2 | 35 | 0.7 | 46 | 0.1 |
| V (25 erg/cm$^2$) [v] | 38 | 0.7 | 26 | 0.6 | 35 | 0.2 |
| @780 nm: dV/dX [volt*cm$^2$/erg] | 226 | 0.1 | 241 | 3.6 | 240 | 4.2 |
| Verase | 23 | 0.4 | 16 | 0.5 | 21 | 0.9 |
| Delta Verase (cyc 100 cyc 3) | 7 | 0.2 | 3 | 0.4 | 4 | 0.3 |
| Temp °F. | 72 | 0.1 | 73 | 0.1 | 73 | 0.1 |
| % RH | 54 | 3.4 | 55 | 1.2 | 53 | 0.3 |

With reference to the abbreviations employed in the TABLE:

V0 (PIDC) is the dark voltage after scorotron charging, as measured by probe 1.

Q/A (PIDC) [nC/cm$^2$] is the charge density required to charge the photoreceptor device to the desired voltage V0

0.2s Duration Decay is the average voltage lost in the dark between probes 1 and 2.

% Dark Decay is 0.2s Duration Decay voltage divided by V0, expressed as a percentage.

@0.42s: VH(0 erg) is average dark voltage at probe 2.

V (3 erg/cm$^2$) is average voltage at probe 2 after exposure to 3 erg/cm$^2$ of 780 nm light.

V (7 erg/cm$^2$) is average voltage at probe 2 after exposure to 7 erg/cm$^2$ of 780 nm light V (25 erg/cm$^2$) is average voltage at probe 2 after exposure to 25 erg/cm$^2$ of 780 nm light.

@780 nm: dV/dX is the initial slope of the PIDC obtained using 780 nm light.

Verase is average voltage at probe 4 after erase exposure.

Temp ° F. is the scanner chamber environment temperature in degrees Fahrenheit.

% RH is the scanner chamber environment percent relative humidity, a measure of the water content in the air.

The salient results to note for comparison in TABLE B are the lower erase residual and PIDC tail, (as parametrized by the voltages for 7 and 25 ergs/cm$^2$), for the hole blocking layer of Example II, compared with both the polyamide blocking layer of Example I and the hydroxygallium phthalocyanine blocking layer of Example III. Although inspection of the respective Q-V TABLES show slightly more dark decay at higher fields for the pigmented blocking layers of this invention compared with the polyamide reference blocking layer of Example I, it should be noted that the blocking layer device of Example II retains charge comparable to the polyamide comparative device, as noted in the $V_H$ and Q/A values where $V_H$ is 374 vs. 379 volts with Q/A of 50 vs. 49 nC/cm$^2$, respectively. The hole range in the blocking layer of Example III has not been optimized for use as a blocking layer. Example II, however, provides quite adequate blocking.

EXAMPLE V

An electrophotographic imaging member was prepared by applying by dip coating a charge blocking layer onto the honed surface of an aluminum drum having a diameter of 4 cm and a length of 31 cm. blocking layer was formed by dip coating the aluminum drum in a blocking layer coating mixture containing 6 weight percent dibromoanthanthrone pigment particles, 4 weight percent poly(vinylbutyral), 90 weight percent cyclohexanone solvent. The weight percent ratio of dibromoanthanthrone to poly(vinylbutyral) was 60:40. The coating mixture contained 10 percent solids. This coating was applied at a coating bath withdrawal rate of 300 millimeters/minute. After drying in a forced air oven, the blocking layer had a thickness of 0.5 micrometer. The dried blocking layer was then coated with charge generator layer and charge transport layer as described in the Example I. The resulting device was tested in a cyclic scanner as described above for photoinduced dark discharge (PIDC) characteristics and in a motionless scanner for high field induced dark discharge (FIDD) and long term cycling for 30,000 in the B zone (24° C. and 40 percent RH), then 30,000 cycles in the A zone (26.7° C. and 80 percent RH). The motionless scanner is described in U.S. Pat. No. 5,132,627, the entire disclosure thereof being incorporated herein by reference. To conduct the FIDD and motionless scanner cycling tests, the photoreceptor sample was first coated with a gold electrode on the imaging surface. The sample was then connected to a DC power supply through a contact to the gold electrode. The sample was charged to a voltage by the DC power supply. A relay was connected in series with the sample and power supply. After 100 milliseconds of charging, the relay was opened to disconnect the power supply from the sample. The sample was dark rested for a predetermined time, then exposed to a light to discharge the surface voltage to the background level and thereafter exposed to more light to further discharge to the residual level. The same charge-dark and rest-erase cycle was repeated for a long term cycling test. The sample surface was measured with a non-contact voltage probe during this cycling period. FIDD is a measure of high field induced dark decay at 2000 volts surface charging and measurement of the dark decay 1.7 seconds after charging. The data showed good PIDC, low FIDD at about 17 percent and 80 percent relative humidity (<300 V) and very stable electrical properties over a total of 60,000 cycles (Vr, residual voltage, and Vbg, background voltage, cycled up to less than 30 V). In the cycling test, the sample was charged to 600 volts surface voltage and discharged to a background voltage of 80 volts and a residual voltage of 20 volts.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a substrate, a hole blocking layer, an optional interface adhesive layer, a charge generating layer, and a charge transport layer, said blocking layer comprising solid finely divided organic photoactive electron transporting pigment particles having a short hole range dispersed in a film forming polymer matrix and said blocking layer comprising between about 40 percent by weight and about 80 percent by weight of said organic photoactive electron transporting pigment particles based on the total weight of said blocking layer.

2. An electrophotographic imaging member according to claim 1 wherein said organic electron transporting pigment particles is benzimidazole perylene.

3. An electrophotographic imaging member according to claim 1 wherein said organic electron transporting pigment particles is dibromoanthanthrone.

4. An electrophotographic imaging member according to claim 1 wherein said pigment particles have an average particle size of between about 0.005 micrometer and about 2 micrometers.

5. An electrophotographic imaging member according to claim 1 wherein said pigment particles have an average particle size of between about 0.01 micrometer and about 0.5 micrometer.

6. An electrophotographic imaging member according to claim 1 wherein said charge generating layer comprises a p-type material.

7. An electrophotographic imaging member according to claim 6 wherein said blocking layer has a thickness between about 0.5 micrometer and about 5 micrometers.

8. An electrophotographic imaging member according to claim 1 wherein said charge generating layer comprises an n-type material.

9. An electrophotographic imaging member according to claim 8 wherein said blocking layer has a thickness between about 0.1 micrometer and about 5 micrometers.

10. An electrophotographic imaging member according to claim 1 wherein said film forming binder has a resistivity of at least about $10^8$ ohm-cm.

* * * * *